US005564505A

United States Patent [19]

Moliere

[11] Patent Number: 5,564,505

[45] Date of Patent: Oct. 15, 1996

[54] SPRINKLER MOUNTED TO PIVOTABLE CONDUIT

[75] Inventor: Alain Moliere, Colomiers, France

[73] Assignee: Etablissements Molière SA, Pibrac, France

[21] Appl. No.: 420,601

[22] Filed: Apr. 12, 1995

[30] Foreign Application Priority Data

Apr. 12, 1994 [FR] France ..... 94 04420

[51] Int. Cl.[6] ..... A62C 37/08

[52] U.S. Cl. ..... 169/16; 169/5; 169/17; 169/37; 239/283

[58] Field of Search ..... 169/5, 16, 17, 169/37; 239/282, 283

[56] References Cited

U.S. PATENT DOCUMENTS 1,102,030 6/1914 Fleming et al. ..... 169/16
3,799,271 3/1974 Mitchell et al. ..... 169/16
5,409,066 4/1995 McHugh ..... 169/16

FOREIGN PATENT DOCUMENTS 0555147 8/1993 European Pat. Off. ..... A62C 37/09

*Primary Examiner*—Gary C. Hoge
*Attorney, Agent, or Firm*—Greenblum & Bernstein P.L.C.

[57] ABSTRACT

The installation comprises at least one hose connected by a turning joint to a conduit for distributing an extinguishing fluid. The hose can pivot from a vertical monitoring position to a horizontal position of use around an axis of the conduit. The maintenance in monitoring position is assured by a mechanical attachment affixed between the wall and the hose. A latching element slides away from the opening of the outlet of the hose. An unlatching element has a surface positioned along the trajectory of flow of the fluid in the hose, in a manner such that the flow of fluid towards the exterior of the hose axially displaces the unlatching element towards an unlatched position in which the mechanical linkage attachment between the hose and the wall is broken. The hose can then pivot towards its position of use to spray the zone of the fire.

28 Claims, 4 Drawing Sheets

SPRINKLER MOUNTED TO PIVOTABLE CONDUIT

DESCRIPTION OF RELATED APPLICATIONS

This application is related to French Patent Application No. 94.04420, filed Apr. 12, 1994, the priority of which is hereby claimed under 35 U.S.C. §119, and the disclosure of which is hereby incorporated by reference thereto.

BACKGROUND OF THE INVENTION

1. Field of the Invention

The present invention relates to a fixed fire control apparatus primarily adapted for protecting premises or other enclosures containing inflammable materials.

2. Description of Prior Art and Background Information

There are known fixed apparatus for fighting fires, of the type noted above, constituted by a network of conduits which transport an extinguishing liquid which can, for example, be water. This network is mounted at a distance from the ground, normally in the vicinity of the ceiling and comprises nozzles from place to place with sprayer apparatus for the extinguishing liquid, blocked by heat breakable bulbs. These nozzles with their pulverization apparatus and their bulb project under their respective conduits and are positioned above the zones to be protected. Under the effect of a high elevation in temperature, the fluid contained in each bulb is relied upon to expand which causes the rupture of the bulb. As a result, an orifice of the nozzle opens and the sprinkling of the extinguishing liquid over the zone on fire occurs.

This type of installation which is very widely used is not appropriate for certain premises notably those which must have at the level of their ceiling a particular backdrop adapted to absorb electromagnetic waves for example. Such premises which are utilized to conduct certain tests are sometimes referred to as "deaf chambers".

It is also preferable to avoid the use of these types of installations in the case of premises or enclosures in which there exist substantial risks of rupturing the bulbs as a result of mechanical shocks. This is the case in particular in merchandise warehouses in which very often precautions are taken to avoid any contact of this merchandise with water.

Finally, the installations of the type noted above are essentially aerial and are placed at a distance from the zones to be protected and as a result are not effective for the early treatment of a localized fire.

SUMMARY OF THE INVENTION

The present invention thus has as an object to resolve the problems referred to above by utilizing an installation having sprinkling elements, which are movable from a monitoring or retracted position in which they are protected from mechanical shocks, to a utilization position in which spraying of the extinguishing liquid over the fire zone occurs.

Another object of the present invention is an installation whose sprinkling elements are positioned in the immediate vicinity of the zone which each must protect. This makes possible an early treatment of the fire and avoids the extension of the element to other zones of the unit.

According to the invention, an installation is provided for fighting fires adapted for use in premises. The installation comprises at least one hose, to be positioned adjacent to one of the walls of a zone to be protected. The hose is connected to one of the conduits of a distribution network of an extinguishing fluid. The hose is connected to its conduit by means of a turning joint, whereby the hose is capable of pivoting around the axis of the conduit from a monitoring position in which it occupies a substantially vertical position into a use position, and whereby the maintenance of the hose in the monitoring position is assured by a mechanical attachment affixed between the wall and the hose. The mechanical attachment comprises an unlatching element which slides relative to the outlet opening of the hose, the unlatching element having at least one surface positioned along the trajectory of flow of the fluid in the hose, and whereby under the effect of pressure exerted on the unlatching element by fluid flow towards the exterior, the unlatching element is displaced along the axis of the hose in the direction of flow of the fluid to an unlatching position. In this position the mechanical attachment between the hose and the wall is interrupted to allow for pivoting of the hose towards its position of use.

The premises can contain flammable materials or be empty, while the hose ends in a spraying element. The position of use may be a substantially horizontal position to which the hose pivots at least in part because of its own weight.

According to one embodiment, the unlatching element in the unlatched position is separated from the hose. In this case, the unlatching element of the mechanical attachment comprises a removable blocking plug for the outlet opening of the hose. A linkage is provided between the plug and the wall. The linkage may be made to be flexible.

In another embodiment, the unlatching element of the mechanical attachment is provided with an axial orifice for the passage of fluid, and the unlatching element in the unlatched position remains affixed to the hose. In this case the unlatching element comprises a radial extension extending beyond the periphery of the hose. The extension is traversed along an axis parallel to the axis of the hose, by at least one orifice and the attachment mechanism comprises a support arm for attachment to the the wall provided at its end with a vertical pin projecting upwardly to be engaged in the at least one orifice when the hose is in the monitoring position, and disengaged from the orifice when the unlatching element is unlatched.

The unlatching element may comprise a stock slidably mounted in a bore of a bearing ring mounted at the end of the hose. The stock, in the hose, is provided with a piston at one end and extends to the exterior of the hose. The radial extension extends radially beyond the stock.

A compression spring is positioned around the stock between the bearing ring and the piston of the stock, and the unlatching element is displaced towards its unlatching position against the force exerted by the compression spring. The bearing ring is threadably engaged in a tapping provided at the end of the hose.

A heat breakable bulb may be provided for blocking the axial orifice of the unlatching element. The bulb is positioned between the unlatching element and a rebound plate carried by lateral flaps affixed to the unlatching element.

An abutment means may be provided for limiting the downward pivoting movement of the hose.

The installation can be mounted so as to be entirely seated within a niche in the wall when in the monitoring position. A spring may be interposed between the hose and the wall to accelerate the pivoting of the hose from its monitoring position towards its position of use.

BRIEF DESCRIPTION OF THE DRAWINGS

Other advantages and characteristics of the invention will become clear from the description which follows of one preferred embodiment given by way of non-limiting example. As shown in the annexed drawings.

DETAILED DESCRIPTION

Figure 1:
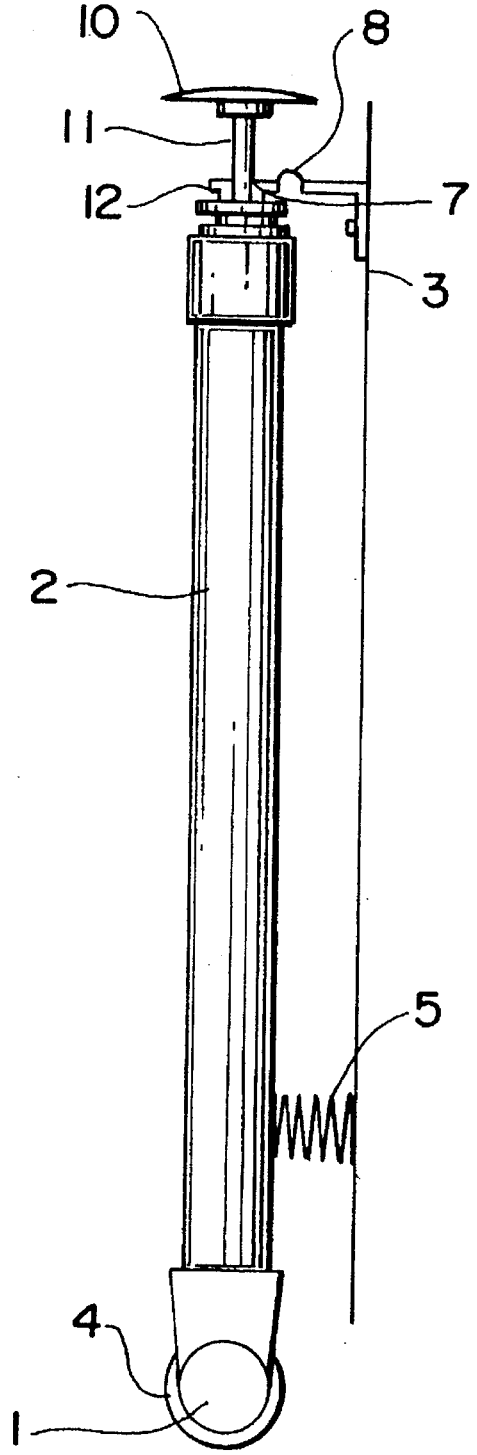
FIG. 1 is a view of a first embodiment of the invention of a unit which fights fires according to the invention, the hose shown in this Figure being positioned in the monitoring position.

The fire extinguishing apparatus according to the invention which is designed to be used in units which can contain flammable materials comprises at least one hose with sprinkling elements positioned in an adjoining manner to one of the walls of the zone to be protected, and is connected to one of the conduits of the extinguishing fluid distribution network. The hose is connected at its conduit by means of a turning joint, and the hose is mounted in a journalled manner on its conduit to pivot around the axis of the conduit from a monitoring position in which it occupies a substantially vertical position, into a position in which it occupies a substantially horizontal position. The maintenance of the hose in the vertical position is assured by a mechanical attachment system which is affixed on the one hand to the wall of the premise and on the other hand to the hose. The mechanical attachment system comprises an unlatching element of which one of the surfaces is positioned along the trajectory of liquid flow in slide attachment with the outlet opening of the hose. The unlatching element, under the effect of pressure exerted thereon by the flow towards the exterior of the extinguishing fluid contained in the hose, is displaceable along the axis of the hose in the direction of flow of the fluid, and towards an unlatched position in which the mechanical linkage between the hose and the wall is broken which allows for the pivoting of the hose towards its position of use, at least under the effect of its own weight.

As shown, the installation for fighting fires according to the invention, is adapted to be used in test laboratories, premises containing inflammable products and any other type of enclosure to be protected against fire.

As illustrated the installation comprises an extinguishing fluid distribution network constituted by one or more conduits 1 for the transport of this fluid which can be water which may further contain wetting or foaming agents. This network of pipes can be connected via a valve which is electrically controlled, to an extinguishing fluid reservoir. A pump for draining the fluid in the reservoir at will and pulsing it into the piping network may also be a part of the installation. The installation includes means for detecting fires and control means. The means for detecting a fire will activate the electrovalve and then the pump in a manner such that the extinguishing fluid is pulsed from the reservoir towards one or more fire hoses 2 across a network of conduits 1. The distribution of the fire hoses in the unit is a function of the distribution of the danger zones. Each danger zone will be equipped with one or more hoses positioned closest to or at the locations where there exists a danger of fire starting in the chamber.

Preferably, the fire hoses 2 of each zone will be positioned in a manner such that they are adjacent to the vertical walls 3 of the latter and will each be able in the monitoring position to be entirely positioned in a niche provided in the wall so as to be particularly protected from shocks. According to the invention, each hose is connected in a journalled manner to its conduit by means of a sealed turning joint 4.

Preferably, the segment of the conduit to which the hose is connected is arranged horizontally such that the fire hose can pivot around the horizontal axis of this segment from a monitoring position towards a use position. In the monitoring position, the hose 2 occupies a substantially vertical position above the conduit while in the position of use, the hose occupies a horizontal or slightly inclined position with respect to the horizontal. The hose in the monitoring position can occupy a slightly inclined position with respect to the vertical in the direction of pivoting towards its position of use such that this pivoting can be caused by the weight of the hose alone.

Preferably, a spring element 5 will be positioned between the hose 2 and the wall 3 in a manner so as to accelerate the pivoting of the hose.

Such a spring arrangement may likewise be employed when the hose must occupy a vertical position or a position of inclination contrary to the direction of pivoting towards the position of use.

The horizontal position of the hose is achieved by a limiting means 6 which opposes the continuing pivoting of the hose downwardly. This limiting means according to the preferred embodiment is constituted by a flexible linkage affixed on the one hand to wall 3 and on the other hand to the stock of the hose. Any other limiting means could likewise be used.

According to the invention, the maintenance of the hose in the protected position is assured by a mechanical attachment system which is affixed on the one hand to wall 3 and on the other hand to hose 1. This mechanical attachment system comprises, an unlatching element 7 of which one of the surfaces 7A (FIG. 3) faces an internal channel of the hose and extends transversely with respect to the axis thereof in sliding linkage with the hose and more precisely with the outlet opening of the latter. Thus, the element for unlatching by the surface 7A is positioned on the trajectory of flow towards the exterior of the fluid engaged in the hose channel, and followed by the fluid, when the fluid flows towards the outlet orifice. Under pressure it is brought to displace itself axially with respect to the hose 2 and this along the direction of flow of the fluid to an unlatched position in which the mechanical attachment linkage between the hose 2 and wall 3 is broken. The breakage of this linkage allows for the pivoting of the hose towards the position of use. The attachment system, according to the embodiment shown in FIGS. 1 and 2, comprises an unlatching element which, depending upon its unlatching position may become separated from the hose 2. This unlatching element is preferably constituted by a removable blocking plug of the outlet opening of the hose 2. The mechanical system besides the plug comprises a linkage 8 affixed on the one hand to this plug and on the other hand to the wall 3. Preferably, this linkage 8 is flexible, the maintenance of the hose in the monitoring position being assured by the tensioning of a cable. The flexible linkage can be constituted either by a metallic cable or by a small chain or by any other appropriate element. Preferably, the plug comprises a shoulder for limiting the depth to which it is embedded in the hose. The flexible linkage is affixed at one of its ends in a bore provided in the plug. At its other end, this linkage is affixed to an attachment element such as a connector engaged in an orifice of the wall at an appropriate height in a manner such that the cable can be tensioned in a direction which is substantially radial to the hose 2. At a distance from its outlet opening, the hose receives a rebound plate 10 carried by two lateral flaps 11.

Figure 2:
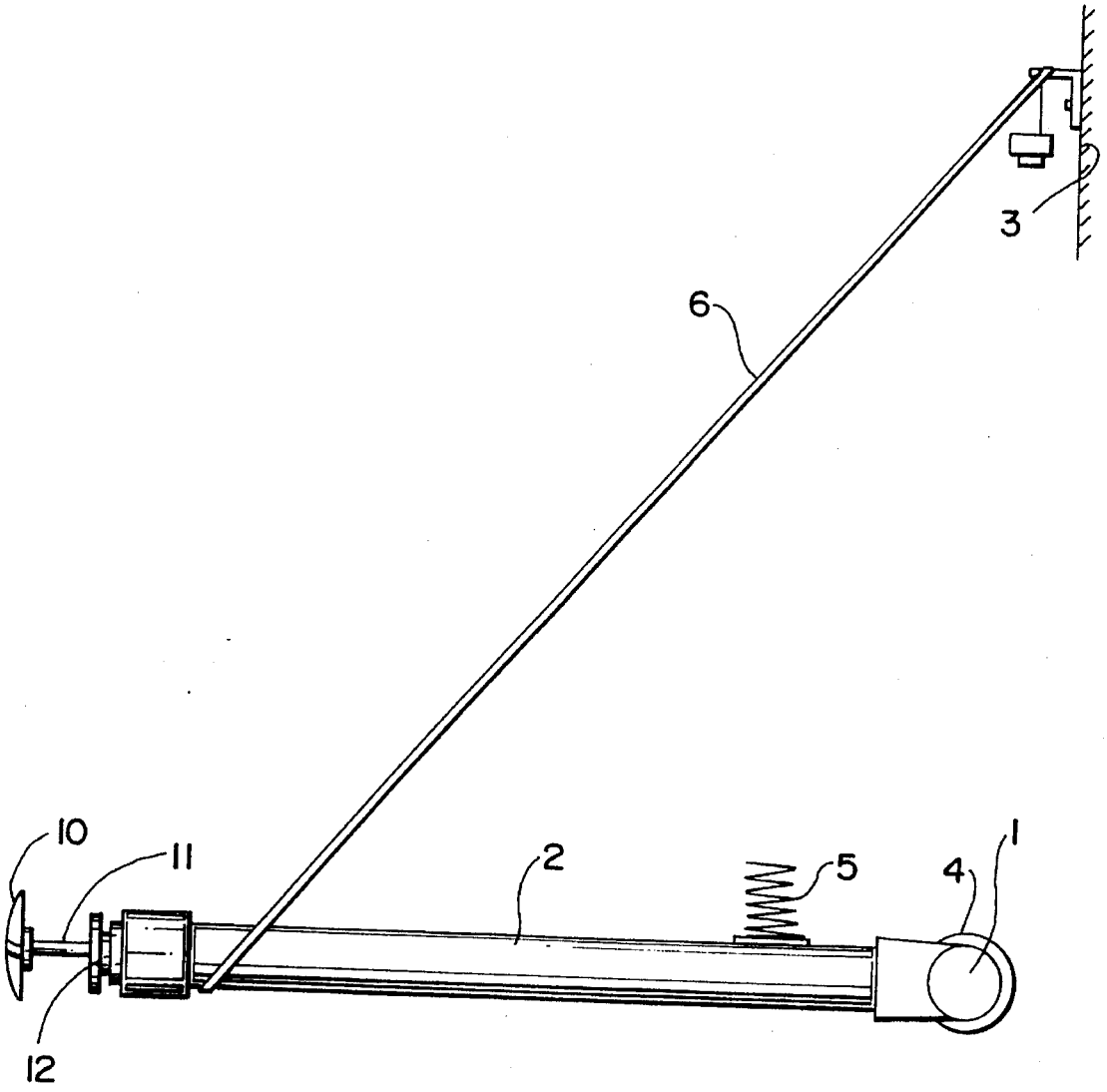
FIG. 2 shows the installation according to the first embodiment, the hose shown in this Figure is in the position of use.
Figure 3:
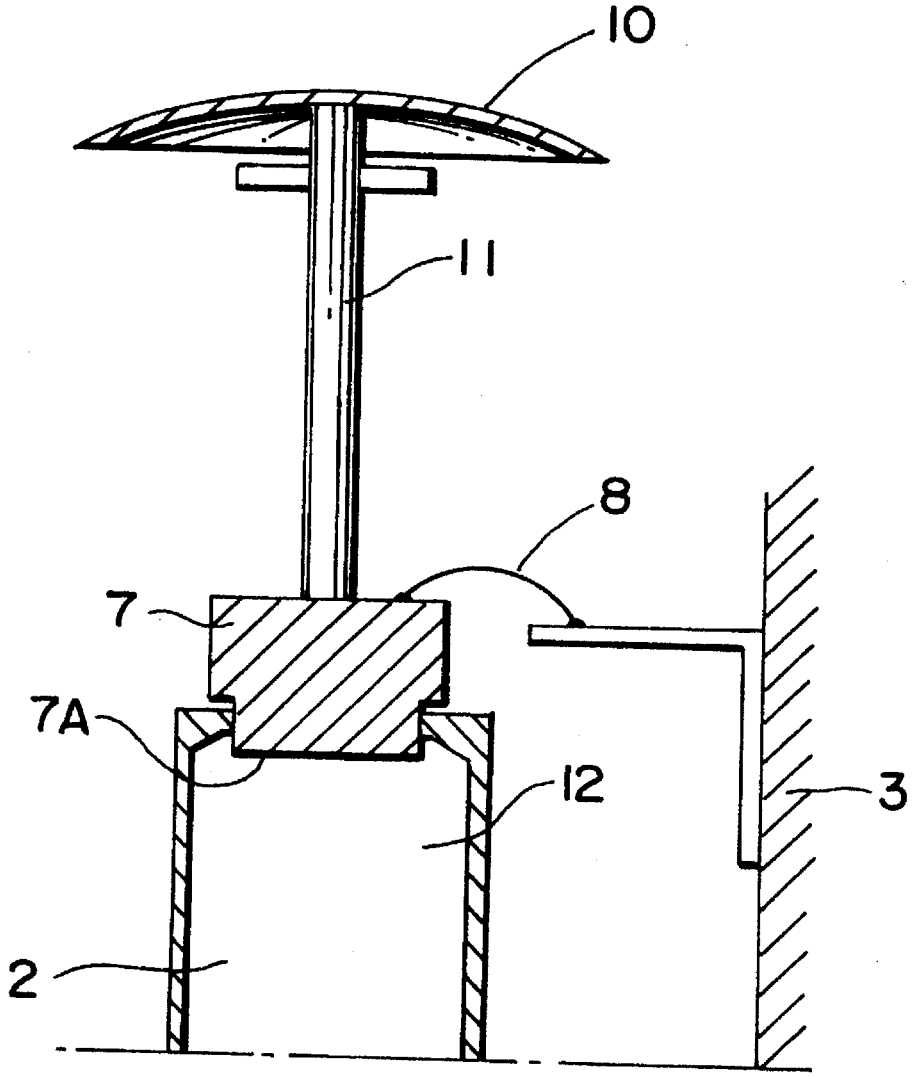
FIG. 3 shows the details of the latching element.

The installation according to the embodiment which is shown in FIGS. 1 and 2 is equipped with a dry network and without distribution pressure of the extinguishing fluid. Furthermore, this installation comprises a means for detecting fire which is known to one of skill in the art, delivering, when a fire is detected, an activation signal of the electrovalve and of the pump in a manner such that the extinguishing fluid is pulsed into the conduit. This fluid hits the surface 7A of the plug or compresses the air contained in the hose which pushes the plug and frees the hose from its protected position.

Figure 4:
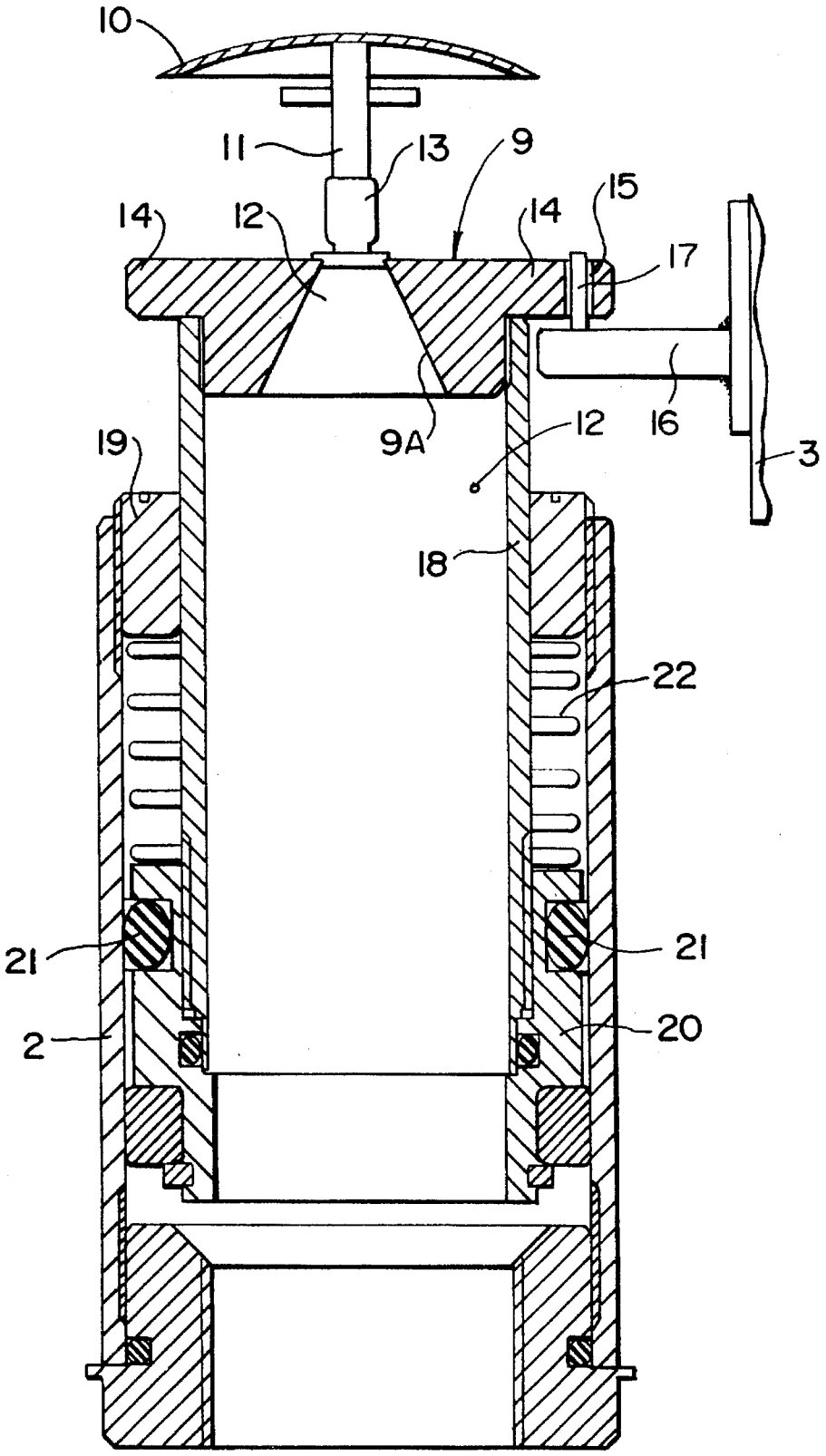
FIG. 4 is a longitudinal cross sectional view of a hose and of attachment systems according to a second embodiment.

FIG. 4 illustrates an installation with the conduit network under the pressure of the extinguishing fluid. The unlatching element 9 of the attachment system according to FIG. 4 is traversed around its axis by an orifice 12 for passage of the extinguishing fluid. This axial orifice is externally blocked by a heat breakable bulb 13 positioned between element 9 and a rebound plate 10 carried by lateral flaps 11 affixed to element 9. At the interior, the passage orifice 12 opens into a conical cavity of the unlatching element. This cavity is flared towards the nozzle of the hose and is defined by a concave surface 9A receiving the pressure of the fluid. Whereas the unlatching element according to FIG. 3 always remains affixed to hose 2, according to this embodiment, the unlatching element comprises a radial extension 14 external to the hose 2 traversed on both sides parallel to the axis of the hose 2 by an orifice 15. This radial extension can form an annular rim around the unlatching elements. This attachment mechanism comprises an attachment to the wall 3, a horizontal arm 16 supporting a vertical pin 17 projecting upwardly, and engaged, when the hose is in the monitoring position, in orifice 15 of the radial extension. When the unlatching element 9 is brought to the unlatching position by axial movement upwardly under the effect of the pressure of the fluid, the orifice 15 of the radial extension is freed from pin 17, which allows for the pivoting of the hose 2 towards its position of use.

Whereas the term hose is used loosely to designate element 2, it should be noted that this element may be a pipe or any other element, and that as shown in FIG. 4, the hose ends in a tubular element which strictly speaking is shown to be separate from but connected to the hose. For purposes of this application no distinction is made between the hose, and the tubular element at the end of the hose.

Preferably, the unlatching element 9 comprises a stock 18 slidably mounted in a bore of a bearing ring 19 mounted at the end of the hose 2. The stock 18, in the hose, is provided with a piston 20 which extends to the exterior of the hose of the axial extension. Stock 18 is in the form of a cylindrical tube. By passage through the bore of the bearing ring 19, the stock penetrates into hose 2. The bore of the stock which is open at the lower end is defined at the upper portion by the surface 9A. At the lower end, the stock receives piston 20 which is attached to slide in the cylindrical bore of the hose against the cylindrical surface of the latter. The piston 20 will comprise, as known, one or more sealing rings 21 which seal against the cylindrical surface of the hose 2. Preferably, a compression spring 22 is positioned around the stock 18 between bearing ring 19 and piston 20, such that the unlatching element is displaced towards its unlatching position against the action exerted by compression spring 22. Preferably, bearing ring 19 is threaded and is engaged in a tapping provided at the end of the hose. In the monitoring position, radial extension 14 under the effect of the compression spring is supported against the support arm 16. Alternatively, the stock is carried against an internal shoulder of hose 2. The extinguishing liquid under pressure in the hose, exerts an axial pressure on surface 9A and the piston 20 of element 9. While the installation is in the monitoring condition, the force exerted by compression spring 22 on piston 20 compensates for the axial pressure exerted by the fluid on element 9 and opposes the longitudinal axial movement of element 9 towards its unlatching position. The axial force exerted on piston 20 by spring 22 depends upon the degree of compression of the latter which is defined by the extent to which bearing ring 19 is embedded in the hose. By adjustment of the amount that the bearing ring is embedded in the hose it is thus possible to adjust the threshold value of pressure under which the unlatching element 9 does not move. This threshold value is slightly greater than the static value of the pressure of the extinguishing liquid in the conduit network when the installation is in the monitoring position.

To summarize, to reach the alert or utilization configuration for fighting fires, the pressure of the fluid increases and exceeds the preliminarily determined threshold which leads to displacement of unlatching element 9 towards its unlatching position.

For one such type of installation, the heat given off by a fire leads to the expansion of the fluid contained in the bulb 13 and the breakage thereof. Orifice 12 is then unblocked which causes a drop in pressure in the conduit. The detection of the fire is achieved by detection of this drop in pressure by means of the pressure sensor and other elements (not shown). By virtue of the signal emitted by the pressure sensor, which is representative of a sharp drop in pressure, the electrovalve and the pump are activated such that the extinguishing fluid is pulsed in the conduits at a pressure greater than the predetermined threshold value, and that the unlatching element is pushed upwardly and the orifice 15 disengaged from the pin 17.

Although the invention has been described with reference to particular means, materials and embodiments, it is to be understood that the invention is not limited to the particulars disclosed and extends to all equivalents within the scope of the claims.

I claim:

1. Installation for fighting fires adapted for use in premises, comprising: at least one hose positioned adjacent to a wall of a zone to be protected, said hose being connected to one of the conduits of a distribution network of an extinguishing fluid, said hose being connected to its conduit by means of a turning joint, whereby said hose is capable of pivoting around the axis of the conduit from a monitoring position in which it occupies a substantially vertical position into a use position, and wherein the maintenance of the hose in the monitoring position is assured by a mechanical attachment affixed between the wall and the hose, said mechanical attachment comprising an unlatching element which slides relative to an outlet opening of the hose, said unlatching element having at least one surface positioned along the trajectory of flow of the fluid in the hose, and whereby under the effect of pressure exerted on said unlatching element by fluid flow towards the exterior, the unlatching element is displaced along the axis of the hose in the direction of flow of the fluid to an unlatching position in which the mechanical attachment between the hose and the wall is interrupted to allow for pivoting of the hose towards its position of use.

2. The installation as defined by claim 1 wherein said premises can contain flammable materials, said hose ends in a spraying element, and wherein said position of use is a substantially horizontal position to which said hose pivots at least in part because of its own weight.

3. The installation for fighting fires as defined by claim 1 wherein the unlatching element in the unlatched position is separated from the hose.

4. The installation for fighting fires as defined by claim 3 wherein the unlatching element of the mechanical attachment comprises a removable blocking plug for the outlet opening of the hose.

5. The installation for fighting fires as defined by claim 4 wherein the mechanical attachment comprises a linkage attached between the plug and the wall.

6. The installation for fighting fires as defined by claim 5 wherein said linkage is flexible.

7. The installation for fighting fires as defined by claim 1 wherein the unlatching element of the mechanical attachment is provided with an axial orifice for the passage of fluid, and wherein the unlatching element in the unlatched position remains affixed to the hose.

8. The installation for fighting fires as defined by claim 7 wherein the unlatching element comprises a radial extension extending beyond the periphery of the hose, said extension being traversed along an axis parallel to the axis of the hose, by at least one orifice and, wherein the attachment mechanism comprises a support arm for attachment to the wall provided at its end with a vertical pin projecting upwardly to be engaged in said at least one orifice, when the hose is in the monitoring position, and disengaged from said orifice when the unlatching element is unlatched.

9. The installation for fighting fires as defined by claim 7 wherein the unlatching element comprises a stock slidably mounted in a bore of a bearing ring mounted at the end of the hose, the said stock, in the hose, being provided with a piston at one end and extending to the exterior of the hose, said radial extension extending radially beyond said stock.

10. The installation for fighting fires as defined by claim 9 further comprising a compression spring positioned around said stock between the bearing ring and the piston of the stock, the said unlatching element being displaced towards its unlatching position against the force exerted by the compression spring.

11. The installation for fighting fires as defined by claim 10 wherein the bearing ring is threadably engaged in a tapping provided at the end of the hose.

12. The installation for fighting fires as defined by of claim 7 wherein a heat breakable bulb for blocking the axial orifice of the unlatching element is provided, the bulb being positioned between the unlatching element and a rebound plate carried by lateral flaps affixed to the unlatching element.

13. The installation for fighting fires as defined by claim 1 comprising a limiting means for limiting the downward pivoting movement of the hose.

14. The installation for fighting fires as defined by claim 1 further comprising a spring adapted to be interposed between the hose and the wall to accelerate the pivoting of the hose from its monitoring position towards its position of use.

15. An apparatus for fighting fires comprising at least one hose, adapted to be positioned adjacent to a wall of a zone to be protected, said hose being adapted to be connected to one of the conduits of a distribution network of an extinguishing fluid, said hose being adapted to be connected to its conduit by means of a turning joint, whereby said hose is capable of pivoting around the axis of the conduit from a monitoring position in which it occupies a substantially vertical position into a use position, and wherein the maintenance of the hose in the monitoring position is assured by a mechanical attachment affixed between the wall and the hose, said mechanical attachment comprising an unlatching element detachably movable relative to the outlet opening of the hose, said unlatching element having at least one surface positioned along the trajectory of flow of the fluid in the hose, and whereby under the effect of pressure exerted on said unlatching element by fluid flow towards the exterior the unlatching element is adapted to be displaced along the axis of the hose in the direction of flow of the fluid to an unlatching position whereby the mechanical attachment between the hose and the wall is interrupted to allow for pivoting of the hose towards its position of use.

16. The apparatus as defined by claim 15 wherein said premises can contain flammable materials, said hose ends in a spraying element, and wherein said position of use is a substantially horizontal position to which said hose pivots at least in part because of its own weight.

17. The apparatus for fighting fires as defined by claim 15 wherein the unlatching element in the unlatched position is separated from the hose.

18. The apparatus for fighting fires as defined by claim 17 wherein the unlatching element of the mechanical attachment comprises a removable blocking plug for the outlet opening of the hose.

19. The apparatus for fighting fires as defined by claim 18 wherein the mechanical attachment comprises a linkage for attachment between the plug and the wall.

20. The apparatus for fighting fires as defined by claim 19 wherein said linkage is flexible.

21. The apparatus for fighting fires as defined by claim 15 wherein the unlatching element of the mechanical attachment is provided with an axial orifice for the passage of fluid, and wherein the unlatching element in the unlatched position remains affixed to the hose.

22. The apparatus for fighting fires as defined by claim 21 wherein the unlatching element comprises a radial extension extending beyond the periphery of the hose, said extension being traversed along an axis parallel to the axis of the hose, by at least one orifice and, wherein the attachment mechanism comprises a support arm for attachment to the wall provided at its end with a vertical pin adapted to project upwardly to be engaged in said at least one orifice, when the hose is in the monitoring position, and adapted to be disengaged from said orifice when the unlatching element is unlatched.

23. The apparatus for fighting fires as defined by claim 21 wherein the unlatching element comprises a stock slidably mounted in a bore of a bearing ring mounted at the end of the hose, the said stock, in the hose, being provided with a piston at one end and extending to the exterior of the hose, said radial extension extending radially beyond said stock.

24. The apparatus for fighting fires as defined by claim 23 further comprising a compression spring positioned around said stock between the bearing ring and the piston of the stock, the said unlatching element being displaced towards its unlatched position against the force exerted by the compression spring.

25. The apparatus for fighting fires as defined by claim 24 wherein the bearing ring is threadably engaged in a tapping provided at the end of the hose.

26. The apparatus for fighting fires as defined by of claim 15 further comprising a heat breakable bulb for blocking the axial orifice of the unlatching element, the bulb being positioned between the unlatching element and a rebound plate carried by lateral flaps affixed to the unlatching element.

27. The apparatus for fighting fires as defined by claim 15 comprising a limiting means for limiting the downward pivoting movement of the hose.

28. The apparatus for fighting fires as defined by claim 15 further comprising a spring adapted to be interposed between the hose and the wall to accelerate the pivoting of the hose from its monitoring position towards its position of use.

* * * * *